United States Patent [19]

Hogg

[11] 4,240,549

[45] Dec. 23, 1980

[54] DISPLAY CONTAINER FOR COILED WIRE

[75] Inventor: James W. Hogg, Nashville, Tenn.

[73] Assignee: Anchor Wire Corporation, Goodlettsville, Tenn.

[21] Appl. No.: 59,390

[22] Filed: Jul. 20, 1979

[51] Int. Cl.[3] ..... B65D 85/04

[52] U.S. Cl. ..... 206/303; 211/106; 211/49R; 206/389; 206/806; 220/18

[58] Field of Search ..... 206/303, 389, 409, 806, 206/459; 211/106, 49 R; 220/18, 19

[56] References Cited

U.S. PATENT DOCUMENTS

| | | | |
|---|---|---|---|
| 2,642,038 | 6/1953 | Howling et al. | 220/18 |
| 2,672,988 | 3/1954 | Johnson | 211/106 |
| 3,197,031 | 7/1965 | Loetz | 211/49 R |

*Primary Examiner*—William T. Dixson, Jr.
*Attorney, Agent, or Firm*—Fisher, Christen & Sabol

[57] ABSTRACT

A display container for displaying and dispensing a coiled wire product is disclosed having a wire frame which may be hung from a peg board or like surface. The coiled wire may be displayed and dispensed in individual coils stacked one upon the other, or may be displayed in a single coil and dispensed by the customer cutting off the desired length. The container consists of a pair of generally rectangular wire side elements interconnected by a pair of wire bottom cross members and a wire upper cross member. The distance between the bottom cross members is less than the diameter of the wire coil to be displayed, to enable the coils to rest upon the bottom cross members. A pair of hooks are attached to the upper cross member to enable the container to be hung on a peg board or similar structure. A sign or other indicia may be attached between the side pieces across the front of the container to indicate the exact size, length, or type of the wire in the container.

4 Claims, 3 Drawing Figures

DISPLAY CONTAINER FOR COILED WIRE

FIELD OF THE INVENTION

This invention relates to display and dispensing containers formed of wire, more particularly such containers for displaying and dispensing a coiled wire product.

BRIEF DESCRIPTION OF THE PRIOR ART

Coiled wire products of various lengths, sizes, and coatings have innumerable uses in businesses, hobbies, and around the home. However, the retail marketing of such coiled wire products has suffered from ineffective and inefficient packaging for display and dispensing purposes. Some coiled wire products are packaged in boxes having a central opening in one side through which the customer can pull out one end of the wire to the desired length. The boxes prevent the customer from visually inspecting the wire to ascertain if it is the proper size, etc. that he desires before pulling it out of the box. Also, the boxes do not permit efficient display at a retail sales outlets, since they are usually stacked on the floor out of the normal line of sight of the customer. Due to the large number of sizes and types of such coiled wire products, the boxes require an inordinate amount of floor space to achieve even a perfunctory display.

Another typical way of displaying coiled wire products is to merely hang the coils on a peg board hook. However, this also suffers from serious retail marketing drawbacks since it requires an inordinately large area to display a variety of such products, and the different sizes and types may be intermingled during the normal customer inspection prior to purchase. This presents a severe difficulty for the later customer, since he must physically inspect each rack to make sure that he is purchasing the precise type and size desired. The peg board hook type display also presents a severe housekeeping problem for the retail outlet since the coils may fall off the peg board hooks or may be misplaced by customers. This type of display also presents a problem regarding the identification of the coils, since the peg board hooks themselves have no place for signs or other indicia. If the coils are identified by signs placed on the peg board itself, they usually are obscured by adjacent wire coils. This type of display is also costly to the retail merchant, since a clerk must remove all of the coils from their shipping box or container and manually place them on the individual peg board hooks at the store.

Display and dispensing racks made of wire are certainly not new and various designs suitable for the display of hardware items are shown in the following U.S. Pat. Nos. 3,978,799; 3,973,678; and 2,996,192. These patents show wire racks for the display of hardware in general, and lock sets, endless belts, and paint brushes in particular. All of these racks have means for holding and displaying a variety of sizes of the items and all are capable of being hung from a peg board type wall surface. Other wire display racks are shown in U.S. Pat. Nos. 3,115,252 and 3,726,415 for displaying magazines or records, and small packaged articles. These racks also have the capability of being hung from a peg board wall surface. None of these wire racks, however, is capable of displaying and dispensing a coiled wire product wherein the coils are stacked one upon the other to facilitate the removal of the product and neither one discloses hook means that are adjustable laterally.

Wire baskets having a generally rectangular cross section are shown in U.S. Pat. Nos. 2,927,697; 789,117; and 879,772. However, none of the teachings of these references indicate that they are capable of use for the display and the dispensing of a coiled wire product, nor are any capable of being hung from a peg board wall surface.

SUMMARY OF THE INVENTION

The instant invention relates to a wire container for displaying and dispensing a coiled wire product. The wire display container has hook means attached to an upper cross member such that it may be hung from a peg board wall surface. Preferably, the hook means is pivotally mounted and slideable on the upper cross member to permit accommodation of the rack to various types of peg board and to various space configurations allowed by other objects mounted on the peg board. The container comprises a pair of generally parallel wire side members, each having a generally rectangular shape, joined together by a pair of bottom cross members and an upper cross member. The distance between the bottom cross members is less than the diameter of the coiled wire product stored in the container such that the coils rest on the lower cross members and are supported one upon the other. The upper cross member has the peg board hooks attached thereto to support the container. A pair of vertical members may be attached between the upper cross member and one of the bottom cross members to bear against the wire coils to act as a guide to prevent them from becoming skewed or from contacting the peg board on which the wire container is hung.

A sign or other indicia bearing the manufacturer's name, wire size, wire type, etc. is attached to the front of each side member and extends across the front of the basket. The sign may be formed of resilient plastic material and may snap around each of the wire side members. The snap fit enables the sign to be removed and replaced by another sign should it be desired to use the wire container to display and dispense a different size or type of coiled wire product.

It is an object of the present invention to provide a display and dispensing container for a coiled wire product that minimizes the display area required for a given number of coils. This is a particularly important objective since, in the retail marketplace, the success of a product is often determined by its earnings per square inch of display area.

It is a further objective to provide such a container that minimizes housekeeping and setup duties of the retail merchant. In the present invention, the coiled wire product may be placed in the container prior to shipment and, upon receipt, the retail merchant merely has to place it on the peg board display area.

It is an additional objective to provide a display and dispensing container for a coiled wire product that may be displayed at eye level to attract the customers attention, rather than the floor storage area of the prior art dispensing devices.

It is a further objective to provide a display and dispensing container which holds either individual coils of wire, or coils of wire joined together and to minimize the disruption to the display during the selection process by the customer. Using a basket according to the invention, the customer need merely lift out the number of coils desired and cut off the remainder with a cutting device attached to the display area. The undesired coils need not be removed from the basket, thereby eliminating the possibility of the customer of replacing them in the wrong area.

DETAILED DESCRIPTION OF THE PREFERRED EMBODIMENT

Figure 1:
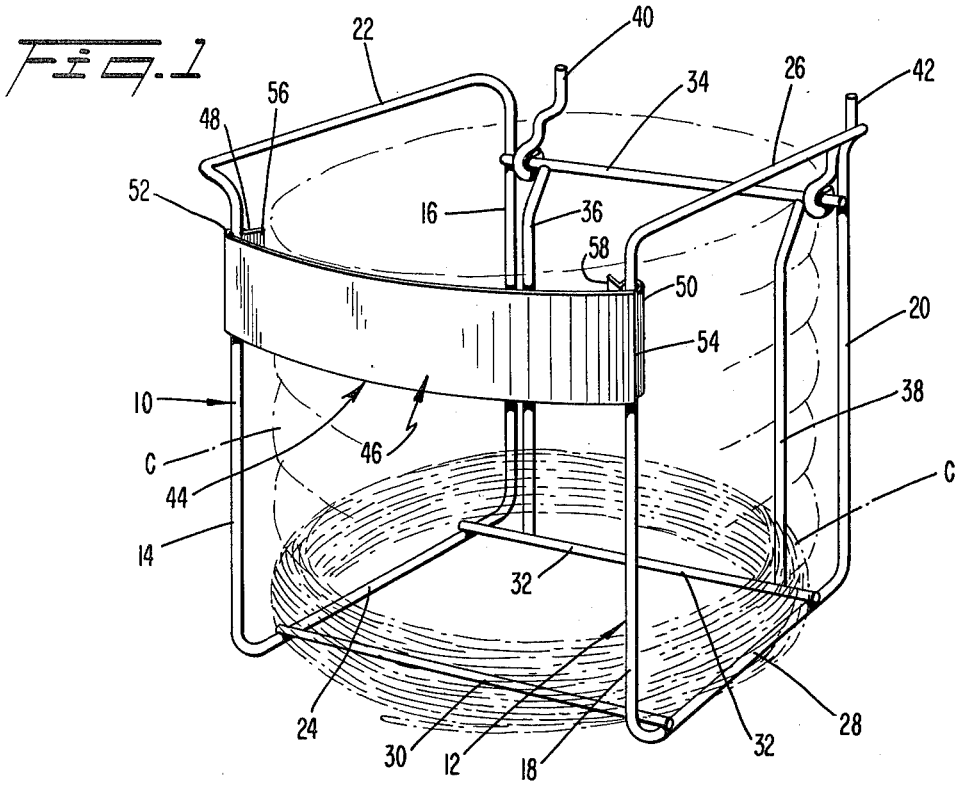
FIG. 1 is a perspective view of a display and dispensing container according to the invention.
Figure 2:
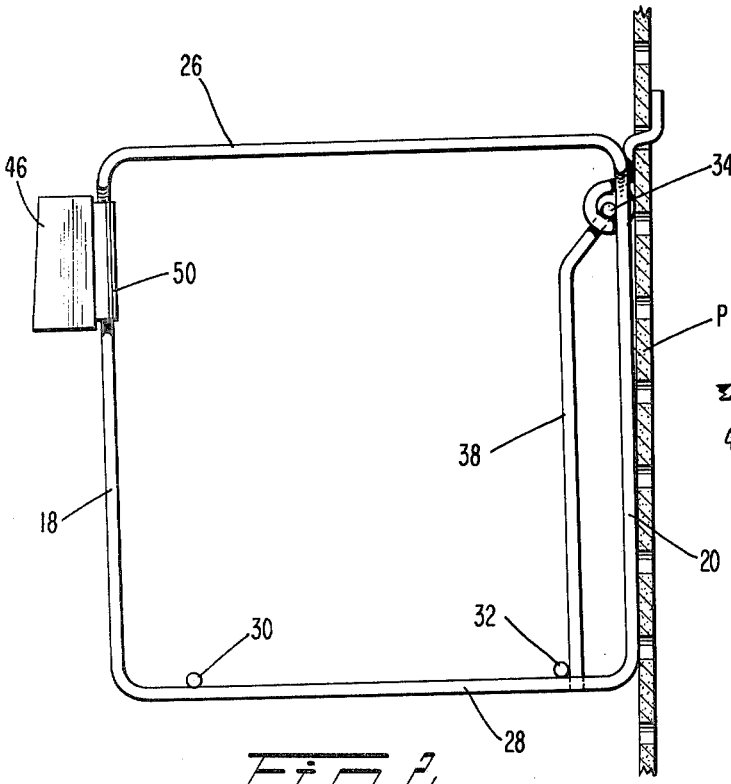
FIG. 2 is a side view of the container hung on a peg board structure.

The display and dispensing container according to the invention is shown in FIG. 1 and comprises wire side members 10 and 12, having a generally rectangular shape and oriented generally parallel to each other. Each side member 10 and 12 comprises front and rear side elements 14 and 16, and 18 and 20, respectively, as well as top and bottom elements 22 and 24, and 26 and 28, respectively. The side members 10 and 12 as shown are of generally rectangular shape but can be of other suitable shapes such as circular or triangular and are joined to front and rear bottom cross members 30 and 32, respectively, and upper cross member 34. The distance between the bottom cross members 30 and 32 is preferably less than the outer diameter of the coils C of wire product to be contained by the container, to enable the coils to rest on the cross members. Rear vertical members 36 and 38 are joined to upper cross member 34 and rear bottom cross member 32 to assist in the proper location of the wire coils within the container and to space the wire coils away from the peg board P on which the container is mounted. The distances between the two front side elements 14 and 18, between the two rear vertical members 36 and 38, between the rear vertical element 36 and front side element 14, and between the rear vertical element 38 and front side element 18, are each less than the outer diameter of the wire coils C to be contained by the container. In order to facilitate insertion of wire coils C into the container and removal of same from the container, the upper end portions of front and rear side elements 14, 16, 18 and 20 and of rear vertical members 36 and 38 are bent outwardly providing the container with a wide mouth. The size of the wire forming the aforedescribed members may, of course, vary depending upon the size and weight of the coils of wire to be contained therein. It is also within the scope of this invention to join the aforementioned components together by any means, such as welding, brazing, soldering, etc. While the container depicted herein is of a generally rectangular shape, it can be of any other suitable shape, e.g., circular or triangular.

Hook members 40 and 42 are pivotally and slideably attached to upper cross member 34 on sections thereof between the connections of said cross member to rear side element 16 and rear vertical element 36 in the case of hook 40, and between the connections of said cross member to rear side element 20 and rear vertical member 38. Hook members 40 and 42 are generally "Z" shaped so as to hook into the holes a peg board structure. Hook members 40 and 42 can be pivoted vertically around said cross member 34 and are also laterally adjustable by sliding on said cross member to facilitate the attachment of the container to the peg board.

Figure 3:
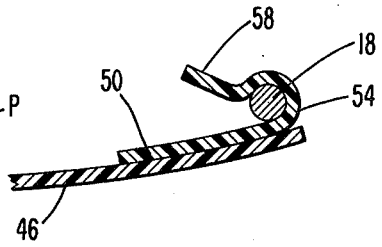
FIG. 3 is a partial sectional view of the indicia member according to the invention.

Indicia bearing member 44 is removably attached to a front portion of front side elements 14 and 18 and bears information concerning weight, type, size of the coiled wire product to facilitate customer identification. Indicia bearing member 44 may be fabricated from any material, e.g., metal, plastic or cardboard, and fastened to the container by any means, but is preferably made of a resilient plastic strip 46 having fastening means 48 and 50 mounted on each end thereof adapted to "snap" over the wire side elements 14 and 18. As shown in FIG. 3, the fastening means 48 and 50 preferably are shaped with cylindrical portions 52 and 54 to encircle a major portion of the circumference of the wire side elements 14 and 18 and are also shaped with flange members 56 and 58 extending at an angle from said cylindrical portion. The fastening means 48 and 50 can also be made of resilient material, e.g., metal or plastic, preferably plastic. The inner diameter of cylindrical portions 52 and 54 is slightly smaller than the diameter of the front side elements 14 and 18 so that said cylindrical portions grip said side elements to hold the strip 46 at any vertical position on said side elements. When it is desired to remove the indicia bearing member 44 the flanges 56 and 58 are pushed away from the plastic strip 46 to further open the cylindrical portions 52 and 54 and permit removal of said cylindrical portions from around said side elements. More than one indicia bearing member 44 can be used if desired. In addition, the heighth of said indicia bearing member is not narrowly critical and can be as much as approximately the heighth of side elements 14 and 18 or as small as practical. It is noted that the indicia bearing member 44 as shown in the drawings is bowed outwardly which provides several advantages including facilitation of removal of wire coils by allowing a bigger mouth; providing a three-dimensional effect to the indicia borne by said member; and permitting limited movement of the upper portions of side elements toward and away from each other. Indicia bearing member 44 is readily removable from the container to allow a given container to be utilized with a variety of different types or sizes of coiled wire and indicia bearing different information thereon.

The afore-described display and dispensing container requires about a 16 percent less space per 50 foot coil of wire than the standard peg board hook. The container according to the invention can retain thirteen 50 foot coils in an area of approximately 808 cubic inches, whereas the standard peg board hook, on which coiled wires are placed, can hold only twelve 50 foot coils in an area of 864 cubic inches. Thus, the afore-described invention is a more efficient and economical way of dispensing and displaying a coiled wire product than the prior art devices.

The foregoing description is for illustrative purposes only, and various modifications may be made thereto without exceeding the scope of the appended claims.

What is claimed is:

1. A display and dispensing container for coiled wire bundles comprising: a pair of wire side members having generally rectangular configuration defining the sides of said container and oriented generally parallel to each other; spaced front and rear wire lower cross members attached to and interconnecting the lower portions of said side members, the distance between said lower cross members and the distance between the vertical front portions of said pair of side members being less than the outer diameter of the coiled wire bundles; at least one upper cross member attached to and interconnecting the upper rear portions of said side members; the distance between the upper horizontal portions at a medial point at least being equal to the outer diameter of the coiled wire bundles to permit their removal; and at least two hook means attached to said upper cross member to enable the container to be hung on a peg board or like surface, each said hook means being vertically pivotal and adapted to be spaced from the outer said hook means and means to horizontally confine the wire bundles within the rack.

2. The display and dispensing container claimed in claim 1 wherein at least one said hook means is laterally adjustable with respect to said container to facilitate hanging on said peg board.

3. The display and dispensing container claimed in claim 1 or 2, further comprising indicia bearing means removably attached to the front of and extending between said wire side members.

4. The display and dispensing container of claims 1, 2 or 3, further comprising a spaced pair of rear vertical members attached to and interconnecting said upper cross member and said rear lower cross member, the distance between said spaced vertical members being less than the outer diameter of said coiled wire bundles to position said bundles in the container and being spaced forwardly of the vertical rear portions of said pair of wire side members to space said bundles from said peg board when said container is hung thereon.

* * * * *